US005149217A

United States Patent [19]

Narita

[11] Patent Number: 5,149,217

[45] Date of Patent: Sep. 22, 1992

[54] SELECTIVELY ACTUATABLE MULTIPLE MEDIUM FEED MECHANISM FOR A MICRO PRINTER

[75] Inventor: Hiroshi Narita, Suwa, Japan

[73] Assignee: Seiko Epson Corporation, Japan

[21] Appl. No.: 507,319

[22] Filed: Apr. 10, 1990

[30] Foreign Application Priority Data

Apr. 10, 1989 [JP] Japan ..... 1-90312
Dec. 20, 1989 [JP] Japan ..... 1-330604

[51] Int. Cl.[5] ..... B41J 11/50

[52] U.S. Cl. ..... 400/608.4; 400/585.1; 400/607; 192/26; 192/84 T

[58] Field of Search ..... 400/584, 585, 585.1, 400/605, 607, 607.2, 608.1, 608.2, 608.4, 185, 187; 192/26, 84 T

[56] References Cited

U.S. PATENT DOCUMENTS

| | | | |
|---|---|---|---|
| 2,213,552 | 9/1940 | Scharr | 400/585.1 |
| 3,006,448 | 10/1961 | Fox | 192/84 T |
| 4,570,768 | 2/1986 | Nishimura et al. | 192/84 T |
| 4,706,562 | 11/1987 | Hori | 101/93.22 |
| 4,793,453 | 12/1988 | Nishimura | 192/26 |
| 4,810,115 | 3/1989 | Hori | 192/84 AA |
| 4,832,244 | 5/1989 | Moriya | 400/585.1 |
| 4,984,914 | 1/1991 | Hayakawa | 400/585 |

*Primary Examiner*—David A. Wiecking
*Attorney, Agent, or Firm*—W. Douglas Carothers, Jr.

[57] ABSTRACT

A plurality of micro medium feed mechanisms are provided at different locations in a printer and are all driven by a single step motor through a plurality of clutches and are selectively capable of feeding several different types of mediums, e.g., a sheet medium, a card medium or a rolled medium, i.e., feeding each such medium independently of the another presented via different inlets to the printer for each different type of medium. The step motor, therefore, functions as the sole driving source for a multiple medium handling type printer thereby providing a less expensive micro printer which is capable of incrementally feeding multiple different kinds of medium types in the same printer wherein printing can be accomplished from the very top edge to the very bottom edge of the fed medium due to the particular locations of the micro medium feed mechanisms in the micro printer. Also, a micro medium feed mechanism provided in at least one medium feed location of the printer is capable of selectively feeding at least one type of medium in predetermined incremental amounts in stepped values less than 1 mm.

6 Claims, 11 Drawing Sheets

1
15
6a
2
2A
6
26
10A
12
21
25
3
3A
11
11A
27
7
7A
9
35
60
34
5
29
25A
10A
8A
8
19
28
4A
4
37

1
25
19
8
8A
10A
4A
17A
17
4
18B
17B
5
9
10A
34
60
37
3
3A
35
7
7A
11
11C
11A
16
18
17C
13
2A
2
12
11B
14B
21
10A
15
10
14A
6A
6
14
14C
18A
22

1
25
19
8
8A
10A
9
5
3
3A
11
11C
13
2
2A
6
6A
10
15
14A
14
10A
11B
14B
18A
12
16
7A
11A
7
35
34
60
37
4
4A
17A
17
18B
17B
18
17C
14C
22

1
25
15
14A
6A
6
2
2A
13
11
3A
11C
10A
14
11B
14B
3
8A
8
19
10
10A
9
5
18A
12
16
7A
11A
7
4A
4
18B
17A
17
34
35
18
17C
14C
22
17B
60
37

1
25
15
14A
6A
6
2
2A
13
3A
11
11C
10A
14
3
11B
21
14B
12
16
11A
7A
7
9
5
10A
8A
8
19
10
4
4A
17A
17
18B
17B
34
60
37
35
17C
18
18A
22
14C 1
25
19
8
8A
10
4A
17A
17
4
18B
17B
5
9
10A
3A
3
34
60
37
35
7
7A
11A
11
11C
3A
11
13
2A
2
15
14A
6A
6
10A
14
11B
14B
21
12
16
14C
18
17C
18A
22

SELECTIVELY ACTUATABLE MULTIPLE MEDIUM FEED MECHANISM FOR A MICRO PRINTER

BACKGROUND OF THE INVENTION

This invention relates generally to a medium feed mechanism for a printer and, in particular, to a medium feed mechanism capable of performing a plurality of different lengths of micro feeding steps in increments of less than 1 mm.

There are two methods currently employed for the purpose of feeding a medium, such as a paper, card, sheet, film, or the like, in incremental steps of less than 1 mm. The first method is illustrated in connection with the drive mechanism shown in FIGS. 12 and 13. Medium feed roller 51 is supported on and secured to shaft 52 and is driven by the gear engagement of ratchet mechanism 50 which is actuated by a drive mechanism in the form of medium feed electromagnet 53 according to the set medium feed pitch. However, in this method, the precision of feeding a medium in micro incremental steps is dependent upon the precision of gear engagement parts 50A and 50B of ratchet 50, which are illustrated in the inset shown in FIG. 13. Furthermore, medium feeding corresponding to printing more than 50 dots per second is difficult. Also, when feeding a plurality of different types of mediums in the same printer, a corresponding number of drive mechanisms in the form of ratchets 50, i.e., at least one for each medium, are necessary together with medium feed electromagnets 53 thereby rendering the entire printer mechanism of large size with a multitude of complicated moving parts, resulting in a high cost printer.

The second method is illustrated in connection with the drive mechanism shown in FIG. 14. Medium feed roller 57 is supported on and secured to shaft 56 and is driven by step motor 54 via coupled gear train 55 providing speed ratio reduction to match or correspond to the desired medium feed pitch. This combination of components shown in FIG. 14 is employed relative to each particular medium feed mechanism so that when a printer is provided with a capability of printing on a plurality of different types of mediums, a corresponding number of drive mechanisms in the form of gear train 55 along with step motor 54 is necessary thereby rendering the entire printer mechanism of large size with a multitude of moving parts, resulting in high cost printers.

It is an object of this invention to provide a compact, simple structured micro medium feed mechanism capable of performing a plurality of independent micro medium feeding functions as well as providing a selected medium feeding increment less than 1 mm employing a single drive means, e.g., a step motor.

SUMMARY OF THE INVENTION

According to one aspect of this invention, a plurality of micro medium feed mechanisms are provided at different locations in a printer and are all driven by a single step motor through speed reduction means and are selectively capable of feeding several different types of mediums, e.g., a sheet medium, a card medium or a rolled medium, i.e., feeding each such medium independently of the another presented via different inlets to the printer for each different type of medium. The step motor, therefore, functions as the sole driving source for a multiple medium handling type printer thereby providing a less expensive micro printer which is capable of incrementally feeding multiple different kinds of medium types in the same printer wherein printing can be accomplished from the very top edge to the very bottom edge of the fed medium due to the particular locations of the micro medium feed mechanisms in the micro printer.

According to another aspect of this invention, a micro medium feed mechanism provided in at least one medium feed location of the printer is capable of selectively feeding at least one type of medium in predetermined incremental amounts in stepped values less than 1 mm. This separate micro medium feed mechanism is independently supported on its drive shaft and includes a medium feed roller and a clutch assembly. The step drive of the rotatably supported medium feed roller in predetermined incremental amounts is made possible by means of controlling the electric current to a electromagnet clutch, rotatably supported on the same drive shaft, so that a predetermined select amount of incremental feeding of a medium is possible, even in the case of medium movement in increments less than 1 mm. The medium drive roller is rotatably fixed to the drive shaft during periods of inactivation of the electromagnetic clutch, at a predetermined speed reduction ratio, via a gear reduction train, by means of the micro step motor. By incremental actuation of the electromagnetic clutch, predetermined amounts of incremental feeding of the medium in the printer is achieved at the surface of the medium feed roller. In particular, by applying an electric current to the electromagnet clutch, which controls the clutch mechanism in the medium feed mechanism and the lateral movement of a clutch spring on the drive shaft, the medium feed roller can be stopped at any selected position by the clutch mechanism even through the drive shaft is continually rotated by the step motor. Thus, when an electric current is supplied to the electromagnet clutch, the clutch plate in the medium feed mechanism is drawn toward the clutch electromagnet. Since the control side of the clutch spring is also held by the clutch plate, the clutch spring will become relaxed relative to its tightened grip on the drive shaft and, as a result, the clutch spring will cease to rotate with drive shaft in spite of continued rotation by the drive shaft via the step motor. Thus, the medium feed roller which is held by the driving end of the clutch spring, will also not rotate with the drive shaft. On the other hand, when an electric current is not supplied to the electromagnet clutch, the clutch spring in the medium feed mechanism remains in a tightened condition or grip on the drive shaft and, as a result, the medium feed roller rotates with the drive shaft via the clutch spring. As a result, the feed roller can be accurately and incrementally rotated in predetermined incremental steps due to the intermittent operation of the electromagnet clutch of the medium feed mechanism.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
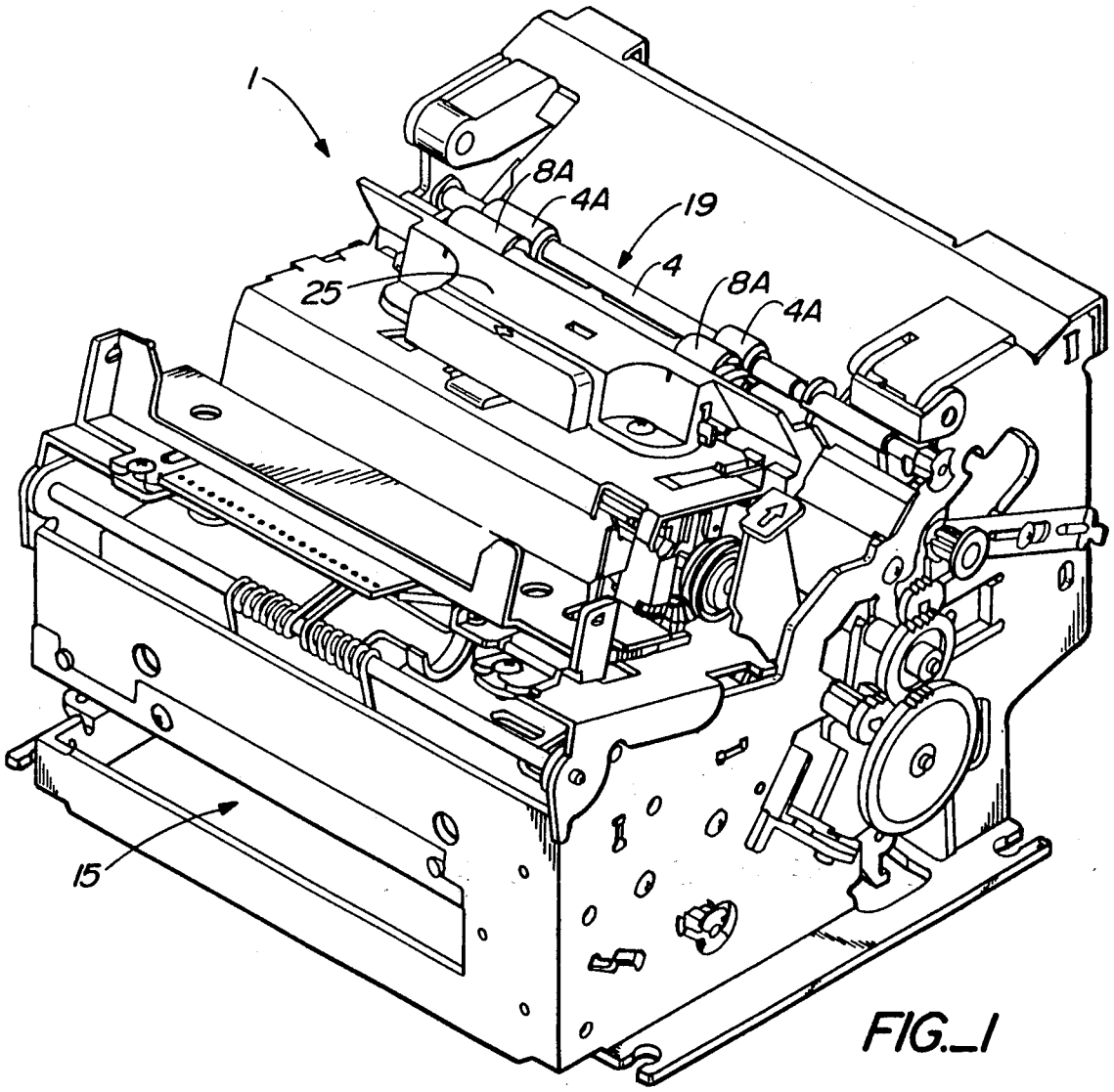
FIG. 1 is a perspective view of a printer comprising an embodiment of this invention.

Reference is now made to FIGS. 1 through 10 for the purpose of describing one embodiment comprising this invention. Micro printer 1 shown in FIG. 1 is capable of handling a sheet medium or card medium or rolled medium utilizing a single drive means in the form of step motor 1A. A typical application for micro printer 1 is in a calculator or cash register.

Figure 2:
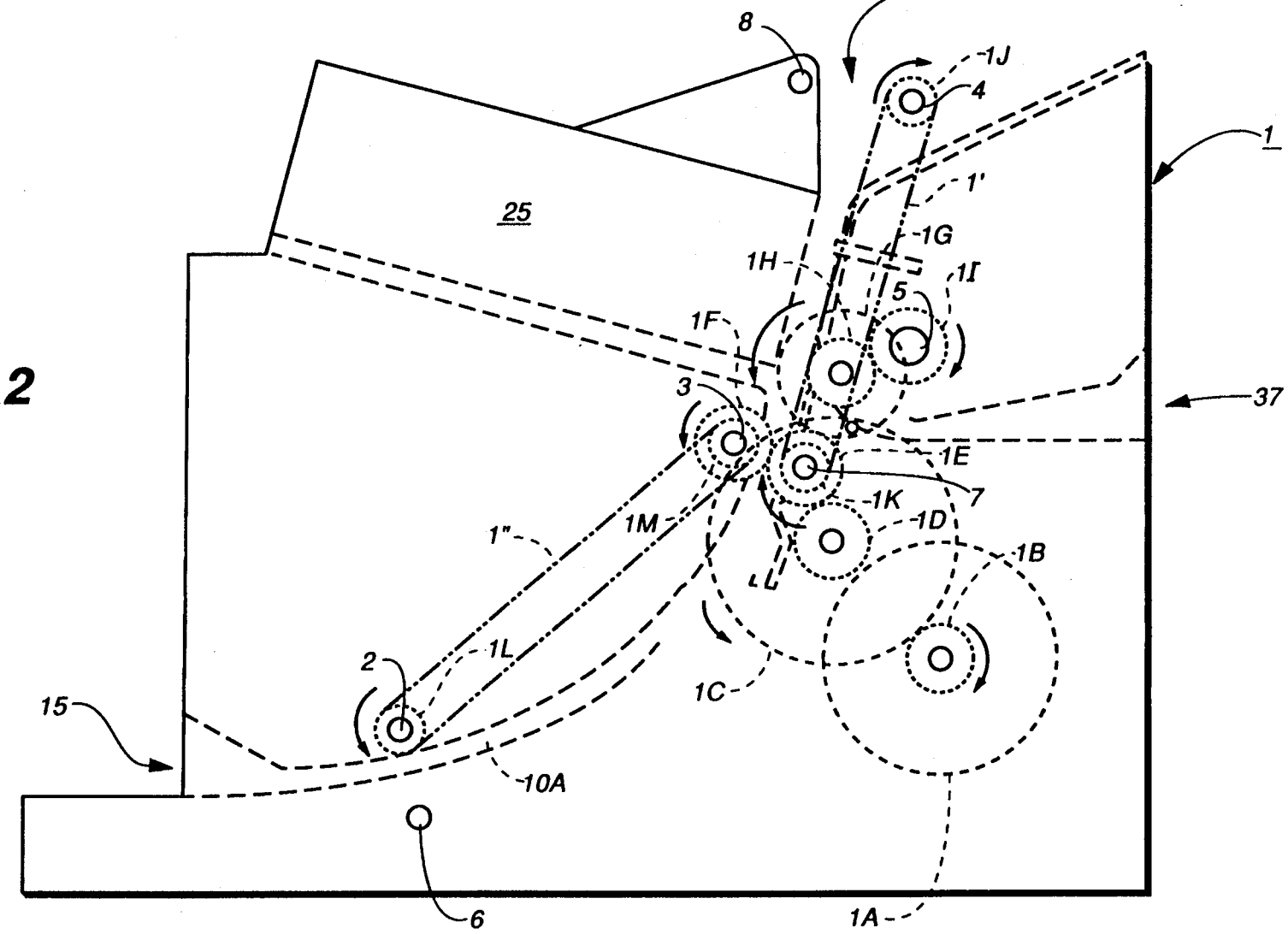
FIG. 2 is a schematic side representation taken from the left side of the printer of FIG. 1 illustrating in phantom the driving arrangement for a plurality of medium feed mechanisms driven by a single step motor.

As shown in FIG. 2, the rotational power of step motor 1A is transmitted to a plurality of drive shafts 2, 3, 4, and 5 via a gear mechanism or train comprising a combination of gears 1B–1I and belts 1′ and 1″. The drive shaft of motor 1A includes gear 1B which drives larger gear 1C for purposes of speed reduction. Gear 1C includes smaller gear 1D which in turn drives gear 1E secured to drive shaft 7. Gear 1E also is coupled to drive gear 1F, secured to card medium drive shaft 3, and large gear 1G. Large gear 1G includes smaller gear 1H which in turn drives gear 1I secured to rolled medium drive shaft 5. Card output drive shaft 4 is driven by belt 1′ coupled between pulley 1J fixed on shaft 4 and pulley 1K. Sheet drive shaft 2 is driven by belt 1″ coupled between pulley 1L fixed to shaft 2 and pulley 1M fixed to shaft 3.

Figure 3:
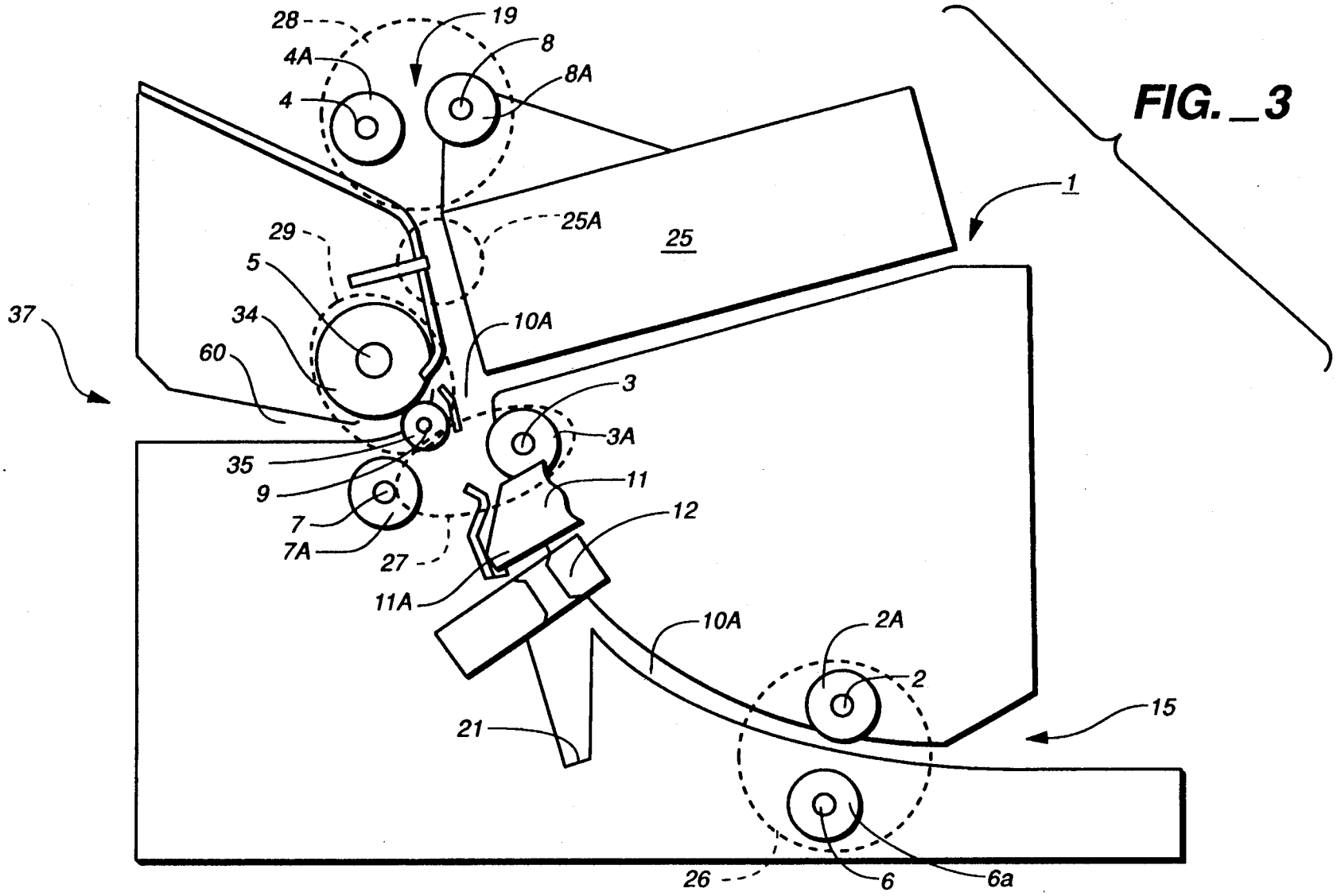
FIG. 3 is another schematic cross sectional right side elevation of the printer shown in FIG. 1 focusing on four regions of separate medium feed mechanisms provided in the printer.
Figure 4:
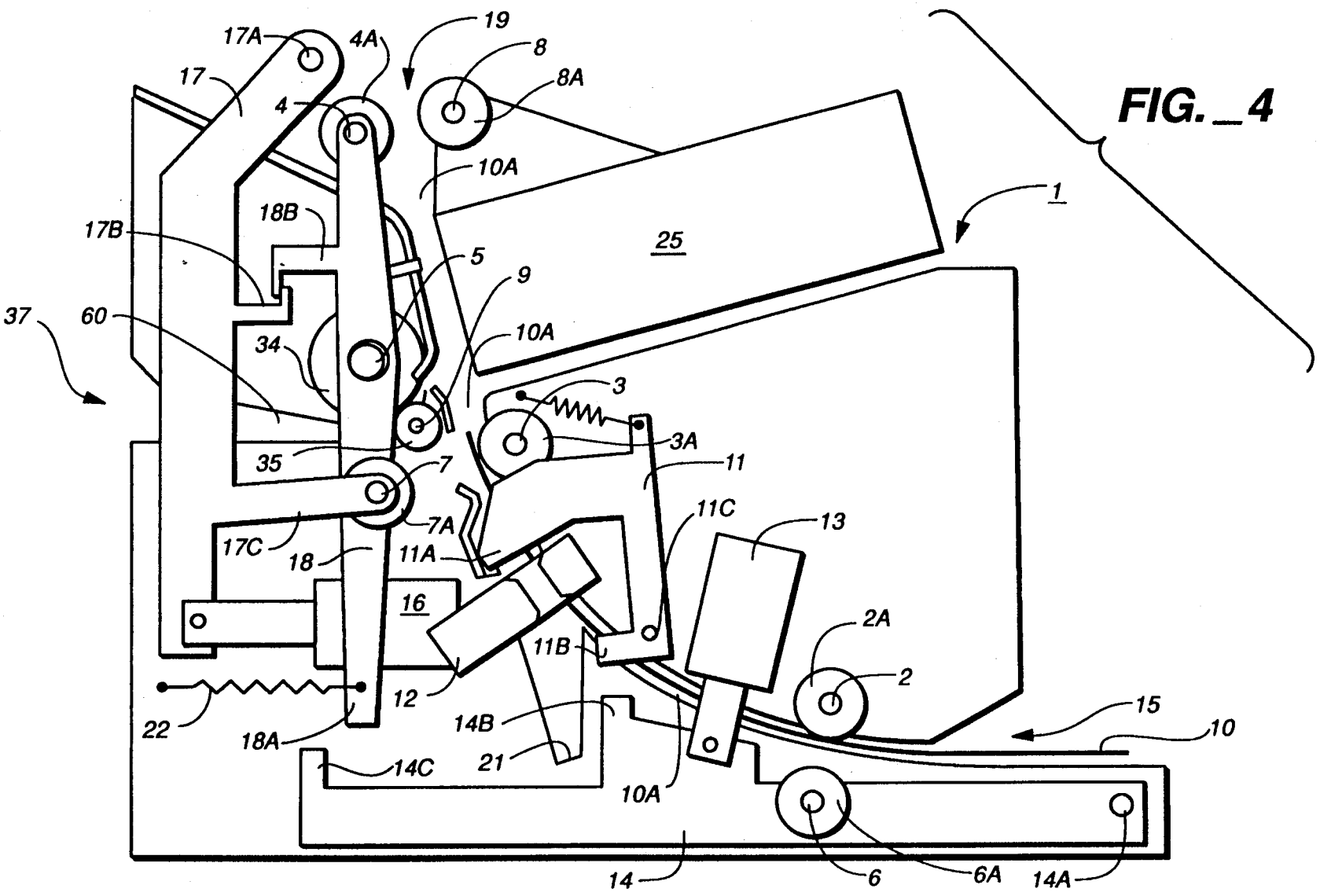
FIGS. 4, 5, 6, 7, 8 and 10 are a series of schematic cross sectional right side elevations of the printer shown in FIG. 1 for the purpose of illustrating the operation of the printer relative to the feeding of three different kinds of medium at the respective medium feed mechanisms.
Figure 6:
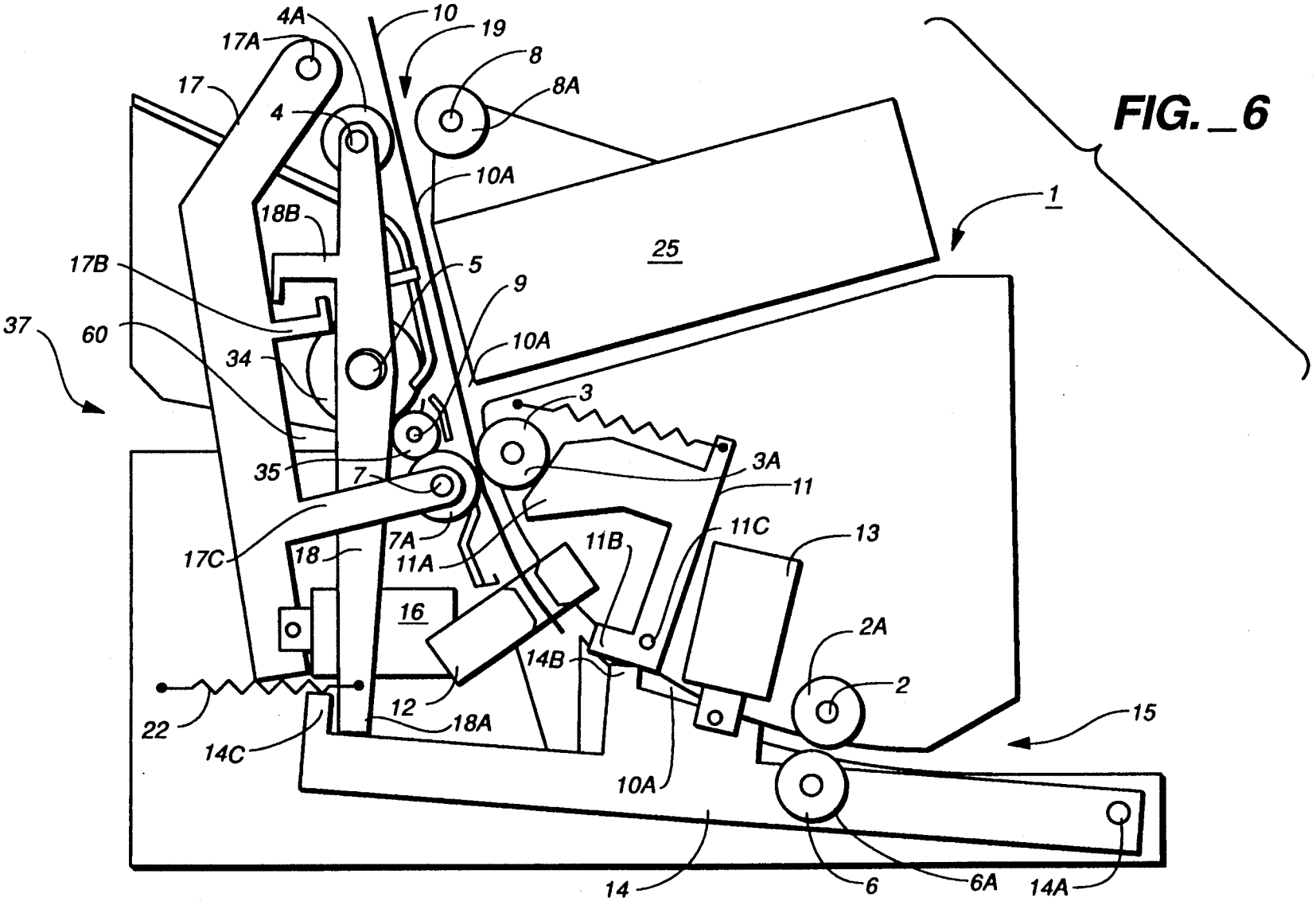

As shown in FIG. 3, each drive shaft 2, 3, 4, and 5 has a corresponding drive roller 2A, 3A, 4A and 34 secured to rotate therewith, except that roller 34 is designed to intermittently engage with shaft 5 as will be explained later. Further, each drive shaft 2, 3, 4 and 5 respectively have a corresponding associated medium shaft 6, 7, 8, and 9. However, it should be noted that associated medium shafts 6, 7, 8 and 9 are support shafts for corresponding idler type support rollers 6A, 7A, 8A and 35, which are each rotatably mounted on their shafts. In this connection, rollers 34 and 35 are in continuous engagement with each other, as depicted in FIG. 3, and roller 34 can be intermittently driven. However, in the case of drive roller 3A and idler roller 7A, these rollers may be disengaged, as shown in FIG. 4, or may be engaged, as shown in FIG. 6. In this connection, one end of drive shafts 3 and 7 are fixed relative to each other so that their respective gears 1F and 1K are always in engaged relationship with each other, as depicted in FIG. 2. However, the other ends of shaft 7 may be separated from shaft 3 by means of the movement via operation of solenoid 16, as depicted in FIGS. 4 and 6, which will be explained in greater detail later. In other words, shaft 7 may be pivotally moved to and away from shaft 3 from a fulcrum point positioned at gears 1F and 1K.

As shown in FIG. 3, different drive shafts 2–5 are positioned in different regions along pathway 10A of printer 1 and these regions are indicated by encircling dotted lines 26, 27, 28, and 29. Sheet medium drive region 26 pertains to drive shaft 2 and its associated medium feed roller 2A, card medium drive region 27 pertains to drive shaft 3 and its associated card feed roller 3A, card output drive region 28 pertains to drive shaft 4 and its associated card medium output feed roller 4A and rolled medium drive region 29 relative to drive shaft 5 and its associated medium support roller 35. Sheet medium feed roller 2A is positioned near sheet insertion inlet 15, card medium feed roller 4A is positioned near card insertion inlet 19, and rolled medium support roller 35 is positioned near rolled medium insertion inlet 37. It should be noted that inlet 19 functions also as an outlet for output drive from printer 1 all three types of medium: sheet, card, and rolled.

Printer mechanism 25 provides conventional means by which three different kinds of mediums, a sheet or slip type of medium, a card medium, or a rolled medium may be printed upon at region 25A as the medium is fed upwardly in pathway 10A and out of inlet 19.

Figure 9:
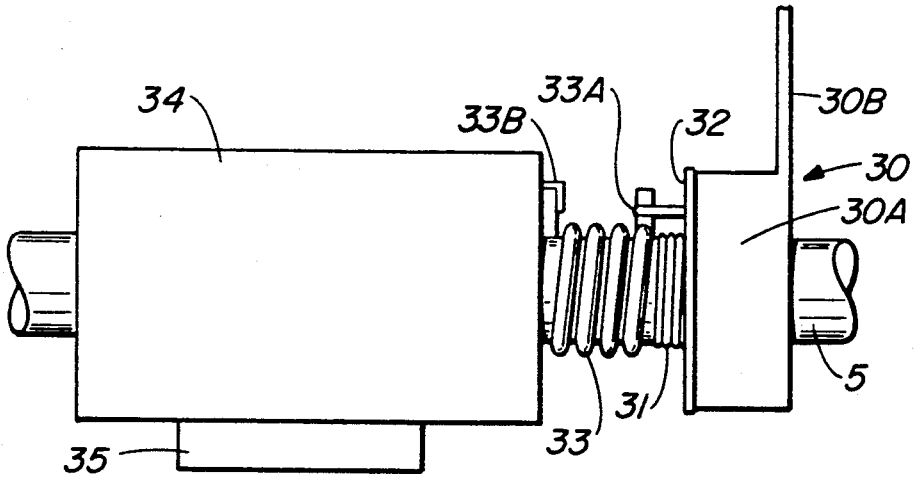
FIG. 9 is a schematic side elevation of a micro medium feed mechanism relative to one embodiment of this invention employed in conjunction with the printer in FIG. 1.
Figure 11:
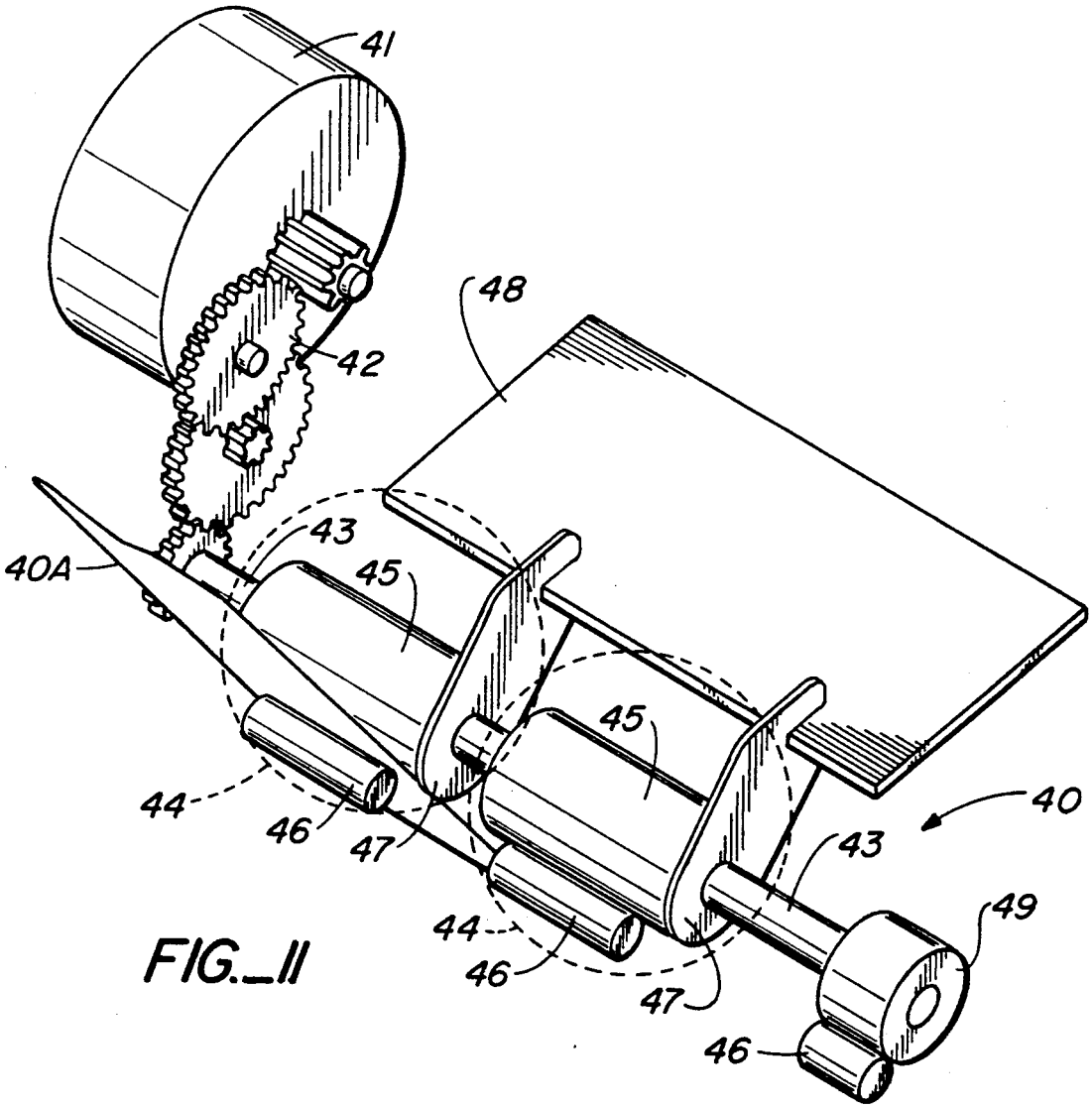
FIG. 11 is a perspective view of a micro medium feed mechanism relative to another embodiment of this invention employed in conjunction with the printer in FIG. 1.

As will be explained in more detail later, a micro medium feeding mechanism 30, shown in FIG. 9, is provided at drive shaft 5 to function as a releasable coupling means for rotatably supported rolled medium feed roller 34. Also, mechanism 30 could also possibly be applied relative to drive shafts 2, 3, and 4 for the purpose of intermittently rotating drive rollers 2A, 3A, and 4A if desired. In any case, mechanism 30 is also rotatably supported relative to shaft 5 and roller 34 will be fixed to and rotate with shaft 5 only when mechanism 30 is in its unactivated condition. Also, more than one such medium feed mechanism releasable coupling means can be supplied relative to a single drive shaft such as illustrated in FIG. 11 and to be discussed later.

Reference is now made to the operation and structure of printer 1 relative to the feeding of a sheet medium 10, such as a sheet or slip of paper; a card medium 20, such as a ridged paper card; and a rolled medium 36, such as a paper roll of cash register or calculator paper.

In FIG. 4, sheet medium 10 is fed into sheet medium insertion inlet 15 relative to sheet medium drive portion 26. When sheet medium 10 is inserted into inlet 15, medium 10 will be engaged by the rotary movement of feed roller 2A and is fed along pathway 10A until the forward end of medium 10 engages toe 11A of stop member 11. Step member 11 also functions as a gage indicating the beginning print position for sheet medium 10. Medium sensor 12 detects the insertion and presence of medium 10 just prior to the forward end of medium 10 engaging the stop member formed by toe 11A. It should be noted that the detection signal developed by medium sensor 12 may be directed, under the control of the operator, to operate either solenoid 13 or solenoid 16. The selective operation of either of these solenoids 13 and 16 is dependent upon whether the operator is in the sheet medium mode or in the card medium mode. If the sheet medium mode is elected, as being discussed here, then the signal from sensor 12 is directed to solenoid 13. If the card medium mode is elected, then the signal from sensor 12 is directed to solenoid 16.

Figure 5:
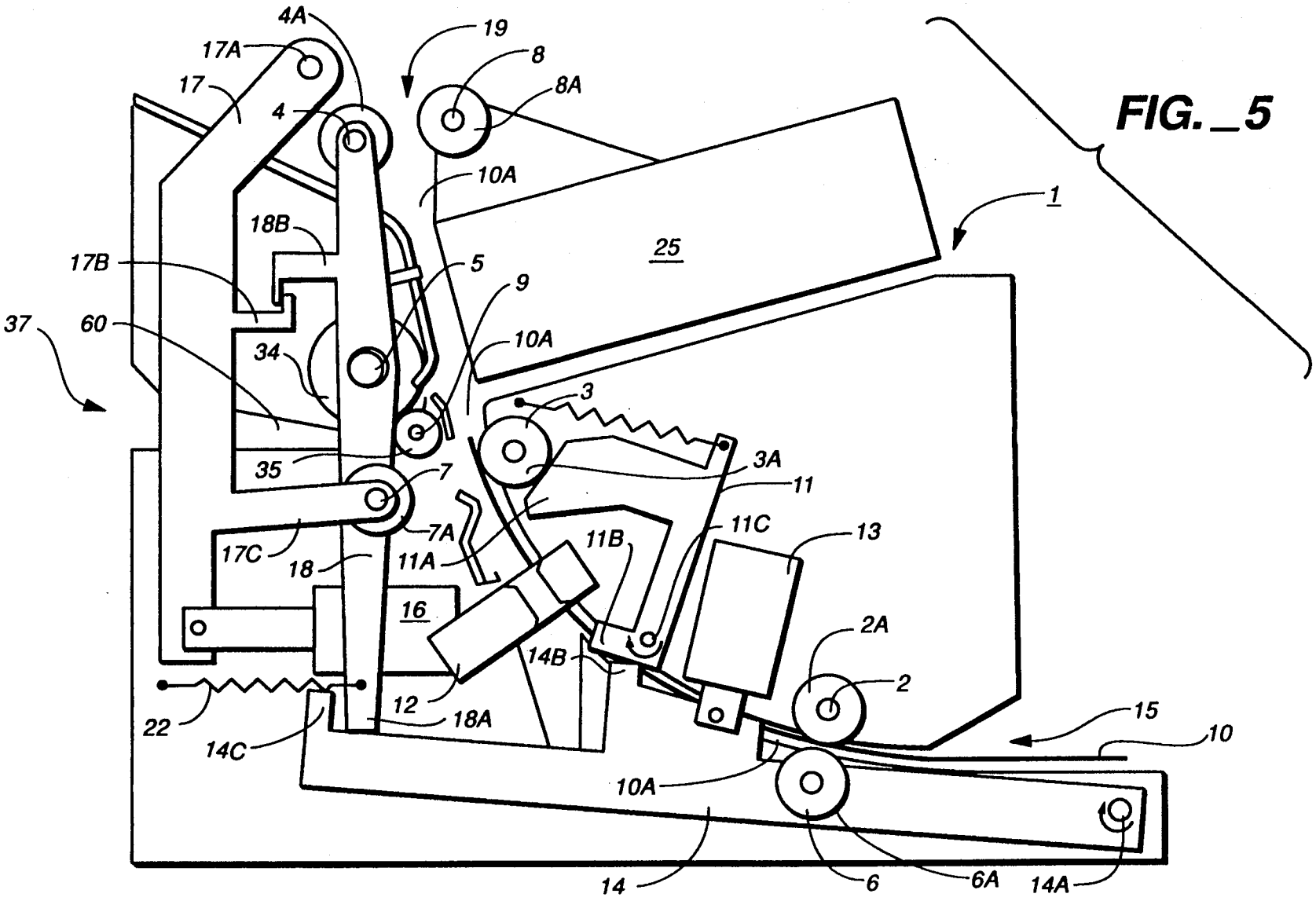

Thus, a signal is supplied from medium sensor 12 to sheet solenoid 13 indicating that sheet medium 10 is present and, as a result, sheet solenoid 13 is activated. The plunger of solenoid 13 is connected to support lever 14 which rotates about point 14A and rotatably supports medium support roll 6A on shaft 6. When solenoid 13 receives a signal from sensor 12 that sheet medium 10 is present, solenoid 13 is actuated to rotate lever 14 in a clockwise direction to bring roller 6A into pressure engagement with roller 2A with medium 10 therebetween, as indicated in FIG. 5. Also, at the same time, upward extending toe 14B of lever 14 engages lever toe 11B of stop member 11 causing lever 14 to also rotate in a clockwise direction moving stop member 11 out of the path of sheet medium 10, as illustrated in FIG. 5. As a result, sheet medium 10 is enabled to continue its movement along medium pathway 10A under the driving power of shaft 2 via step motor 1. As a result, sheet medium 10 is advanced into card medium drive region 27 by driver roller 2A.

The spatial relationship between sheet medium drive shaft 2 and card medium drive shaft 3 is fixed so that, when sheet medium 10 passes beyond the beginning of card drive region 27 by a predetermined amount, as determined by a sensor (not shown), a signal is supplied to card medium solenoid 16. As shown in FIG. 5, the plunger of solenoid 16 is connected to card support lever 17 which is pivotally supported at point 17A. Lever 17 also includes, along one edge, L-shaped extension 17B and extension arm 17C. The outer end of arm 17C rotatably supports roller 7A on shaft 7. When the plunger of solenoid 16 is actuated by such a signal, lever 17 is caused to rotate in a counter clockwise direction about point 17A, as illustrated in FIG. 6. As a result, medium support roller 7A is brought into engagement with card drive roller 3A with sheet medium 10 therebetween to actively drive medium 10 upward along medium pathway 10A.

It should be noted at this time that card medium output support lever 18, which is rotatably supported on shaft 5, is biased by spring 22 to forcibly rotate lever 18 in a clockwise direction. Lever 18 also has a L-shaped extension 18B that is interlocked with L-shaped extension 17B on lever 17 that would otherwise prevent this clockwise rotation. Also, as noted in FIG. 4, with lever 18 held from such clockwise rotation due to lever 17, the bottom end 18A of lever 18 is positioned so that the extended toe 14C of lever 14 is aligned beyond end 18A. Thus, the original activation of solenoid 13 also placed toe 14C in engagement with lever end 18A to also hold lever 18 from such clockwise movement, as illustrated in FIG. 5. As a result, card medium output support lever 18 is temporarily maintained in a fixed condition by toe 14C as illustrated in FIG. 6. In other words, lever 18 is prevented from clockwise rotation by the force of spring 22 and drive roller 4A is prevented from engaging roller 8A rotatably supported on shaft 8 fixed to the frame of printer 1. Thus, card medium output drive region 28 remains in its open state condition as exemplified in FIG. 6.

Figure 7:
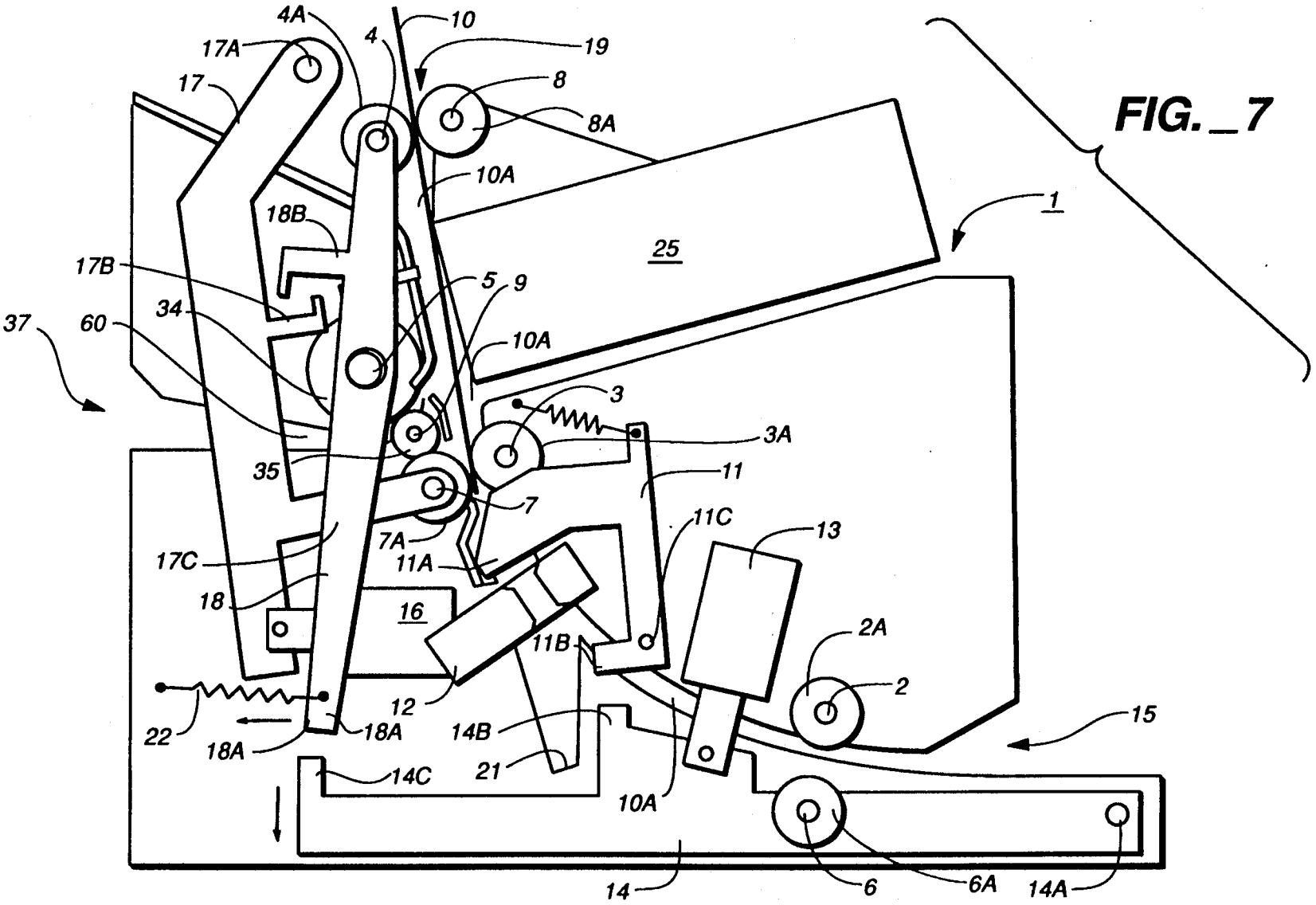

After sheet medium 10 incrementally advances through printing region 25A and thence begins to appear at opening of output drive region 28, the locked condition of card medium output support lever 18 by toe 14C of sheet support lever 14 is released by the withdraw of the applied signal to sheet solenoid 13 since the bottom edge of medium 10 will pass out of sensor 12. As a result, lever 14 rotates in a counterclockwise direction and its toe 14C disengages from end 18A of card medium output support lever 18, as illustrated in FIG. 7. As a result, the force of spring 22 rotates lever 18 in a clockwise direction and places card medium output drive roller 4A into engagement with roller 8A to engage and continually feed sheet medium 10 along pathway 10A and out inlet 19. Thus, feeding sheet medium 10 through printer 10 along medium pathway 10A is performed by the sequential operation of sheet medium drive shaft 2 via drive roller 2A, card medium drive shaft 3 via drive roller 3A and card medium output drive shaft 4 via drive roller 4A.

Figure 12:
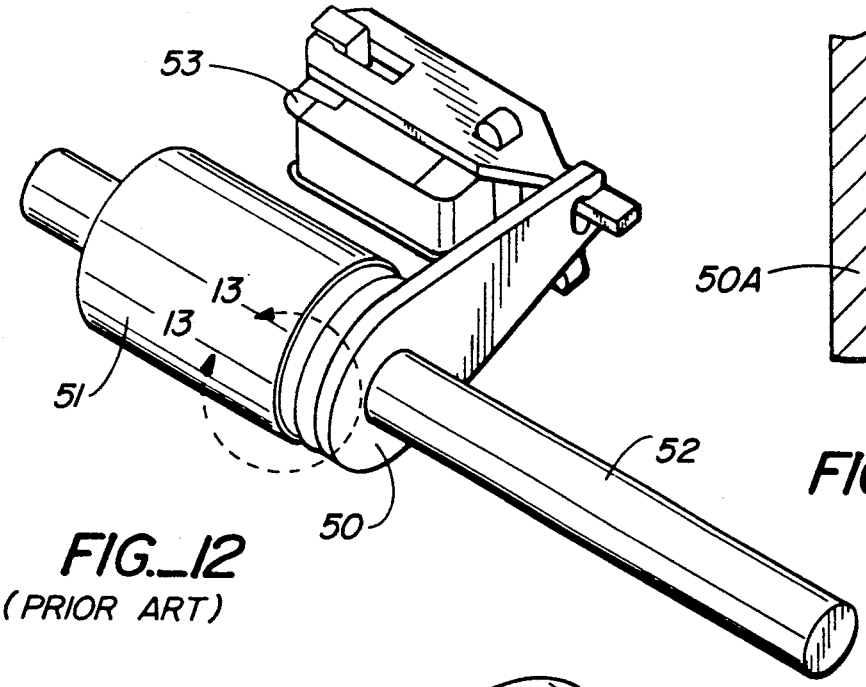
FIG. 12 (PRIOR ART)
FIG. 12 is a perspective view of one micro medium feed mechanism known in the prior art.
Figure 13:
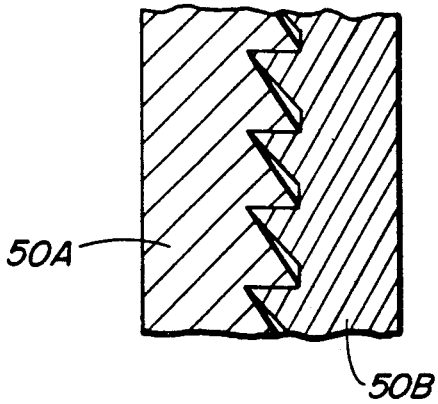
FIG. 13 (PRIOR ART)
FIG. 13 is a detailed illustration of the inset 13—13 encircled in FIG. 12.
Figure 14:
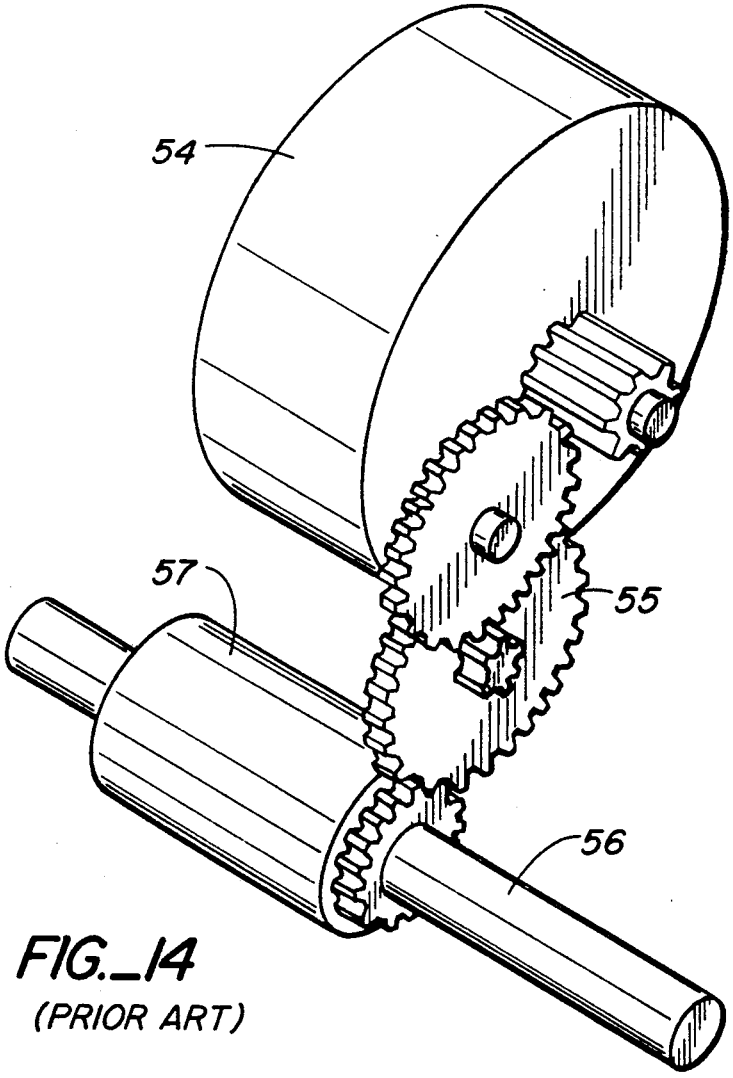
FIG. 14 (PRIOR ART)
FIG. 14 is a perspective view of another micro medium feed mechanism known in the prior art.

In the case of prior art driving methods previously explained relative to FIGS. 12–14, sheet medium traveling between each of the respective drive regions 26, 27 and 28 provided in such a micro printer can encounter problems since the sequence of drive shafts have no inter-rotational drive relationship. As a result, the medium will become slack in regions between adjacent drive roller regions and further resulting in a medium jam in the medium pathway 10A requiring opening of the printer and the removal of the jam. However, in the case of printer 1 of this invention, when step motor 1 is operated and its rotational force is applied to drive shafts 2–5, all drive shafts 2, 3, 4, and 5 rotate concurrently via their associated gear and belt mechanisms shown in FIG. 2. Further, each respective drive shaft 2 and 3 and its corresponding drive roller 2A and 3A cease to be operative on medium 10 after medium 10 has proceeded beyond the respective drive regions 26 and 27. Therefore, no medium slack can occur in the transport of sheet medium 10 in medium pathway 10A. Also, since positive medium feeding means are positioned at adjacent sides of printing mechanism 25 at drive regions 27 and 28, printing from the very top edge of sheet medium 10 to the very bottom edge of sheet medium 10 can be accurately accomplished without slippage of medium 10 during printing at region 25A.

Figure 8:
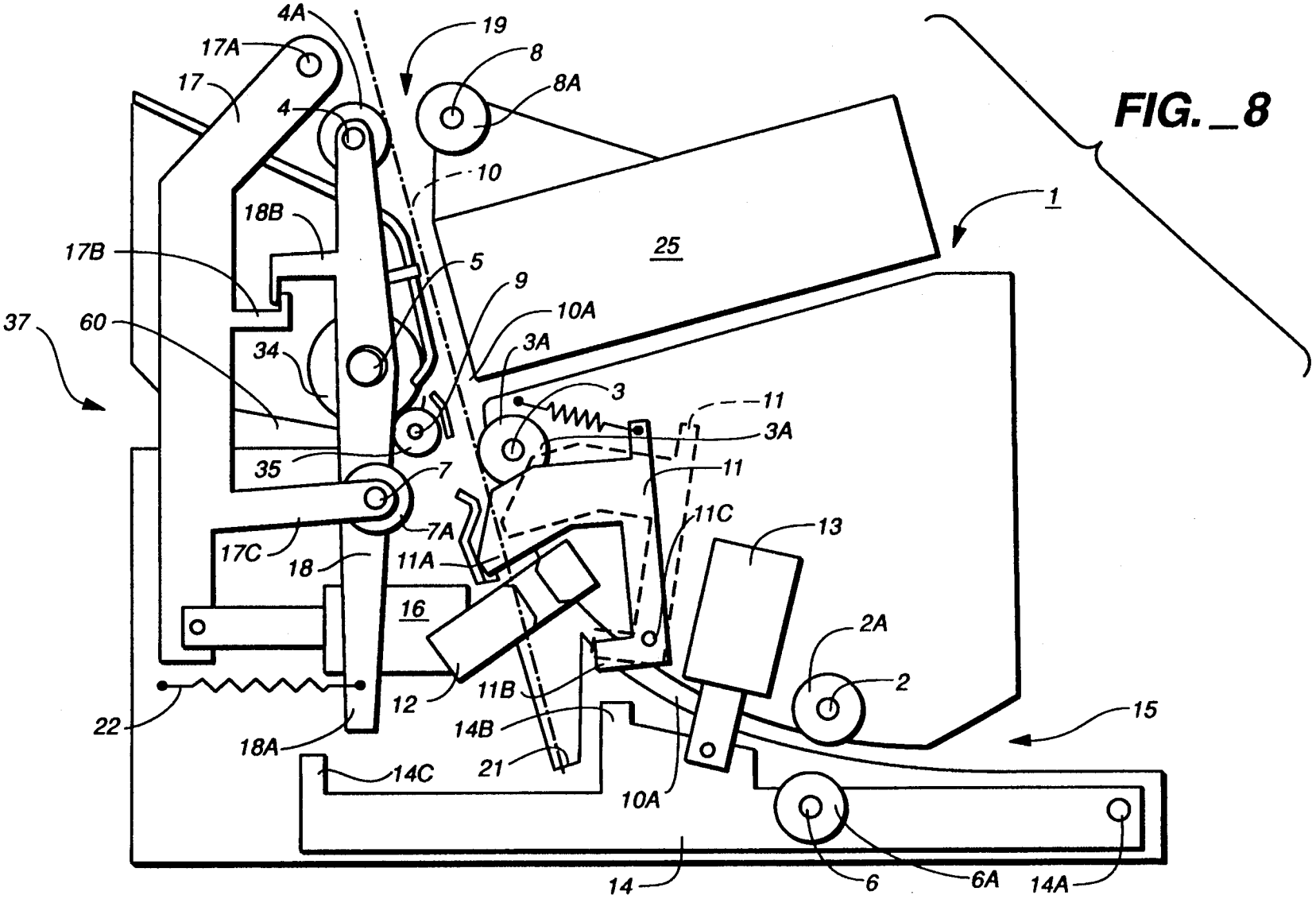

Reference is now made to FIG. 8 and the means by which printer 1 handles the feeding of cards as printing mediums, such as for purposes of validation or the like. First, card 20 is inserted into card insertion inlet 19 at output drive region 28. Card 20 passes printer region 25A and thence through drive region 27 and the forward motion of card 20 is terminated by card stop 21. It should be noted that the forward motion of card 20 to stop 21 is not hindered by the toe 11A of stop member 11 because the rigidity of card 20 is sufficient to move member 11 counter clockwise about pivot point 11C against its biasing means out of pathway 10A. Card 20 also passes through sensor 12 positioned beneath stop member 11 which senses its presence and develops a signal which is supplied to card solenoid 16, rather than sheet solenoid 13, since the printer is being operated in the card medium mode. The plunger of card solenoid 16 is actuated causing card support lever 17 to rotate about pivotal point 17A in a counterclockwise direction thereby causing support roller 7A to engage drive roller 3A with card 20 therebetween, which fundamental action is illustrated in FIG. 7. Also, at the same time, as best illustrated in FIG. 7, L-shaped arm 17B of lever 17 is disengaged from L-shaped arm 18B permittng the biasing force of spring 22 to rotate card output support lever 18 about drive shaft 5 thereby placing support roller 4A into engagement with drive roller 8A with card 20 therebetween. At this point in time, step motor 1A is activated to rotate card drive shaft 3 and output drive shaft 4 so that feeding of card 20 upwardly toward inlet 19 past printing mechanism 25 is accomplished. Since card 20 is securely engaged between rollers 4A and 8A in output drive region 28 positioned above printing mechanism 25, it is possible to print data to the very bottom edge of card 20.

Also, in the situation where card 20 is shorter in length than the length between output drive region 28 and card drive region 27, as in the case of sheet medium feeding, the short card is first engaged and driven by drive roller 3A in card drive region 27 via operation of card solenoid 16. When sensor 12 detects the absence of the card medium, output drive region 28 is made operative and, as a result, card drive region 27 and output drive region 28 are both operational to continuously and incrementally feed the shorter length card out of inlet 19.

Reference is now made to FIG. 9 and the means by which printer 1 handles the feeding of a rolled medium 36. One portion of micro medium feed mechanism 30 for rolled medium 36 is rotatably supported relative to rolled medium drive shaft 5 and rolled medium support shaft 9. Medium feed mechanism 30 comprises electromagnetic clutch 30A, compression spring 31, clutch plate 32 and clutch spring 33. Clutch spring 33 and rolled medium drive roller 34 are secured to each other at 33B and can rotate with drive shaft 5 due to the tight grip of spring 33 on shaft 5. However, electromagnetic clutch 30A and clutch plate 32 are supported on drive shaft 5 but their rotation upon shaft 5 is prevented by stop member 30B which is held or secured to the printer frame (not shown). Clutch plate 32 is biased against electromagnetic clutch 30A by compression spring 31. Clutch plate 32 is also held from rotation by being fixed to the printer frame (not shown). One end 33A of clutch spring 33 is coiled around clutch plate 32 and the other end 33B is fixed to rolled medium feed roller 34 so that rolled medium feed roller 34 will rotate together with rolled medium drive shaft 5 when shaft 5 is driven by step motor 1A.

Figure 10:
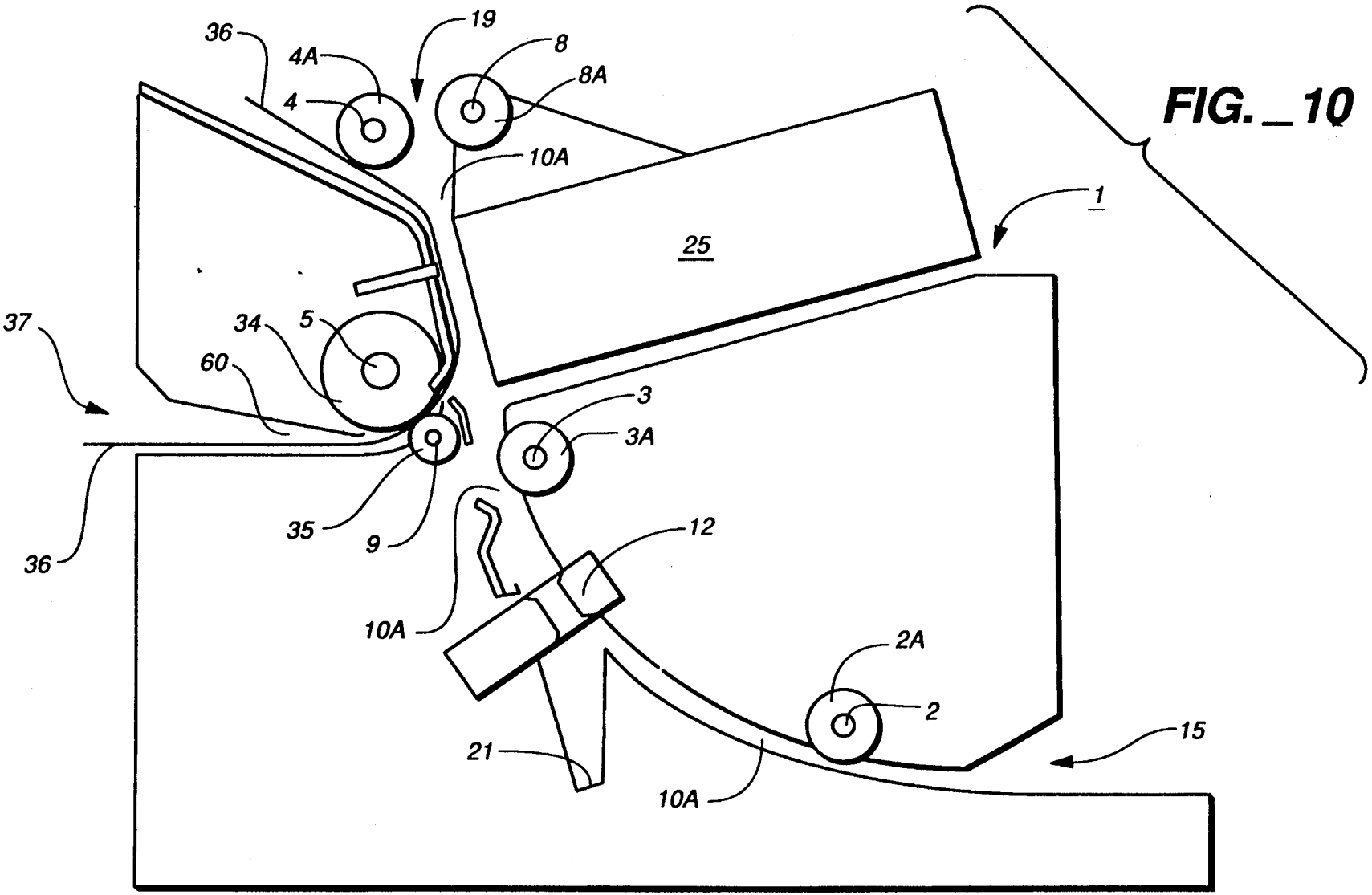

With reference to FIG. 10, the forward end of rolled medium 36 is inserted at rolled medium inlet 37 until it is extended along pathway 60 to a position between rolled medium feed roller 34 and rolled medium support roller 35. It should be noted that rollers 34 and 35 are in engagement at all times. Also, at this time, lever 18 is in its rest position, as shown in FIG. 8. When the forward end of rolled medium 36 reaches the apex of rollers 34 and 35, rolled medium drive shaft 5, driven by step motor 1A, will feed medium 36 therebetween between and up through the upper portion of pathway 10A past printer mechanism 25 and thence if fed beneath output drive shaft 4 at inlet 19, as shown in FIG. 10. The feeding of rolled medium 36 through pathway 60 and the upper portion of pathway 10A is complete and printer 1 continuously feeds medium 36 past printer mechanism 25 by means of rolled medium drive shaft 5 driven by step motor 1.

In operation, medium feed mechanism 30 receives an actuation signal for application to electromagnetic clutch 30 when either a sheet medium 10 or a card medium 20 has been inserted in either inlet 15 or inlet 19 so that rolled medium feed roller 34 is prevented from rotating in spite of the continued rotation of rolled medium drive shaft 5. Thus, a sheet or card medium 10 or 20 can be inserted in printer and fed over existing rolled medium 36 and printing can be accomplished on sheet or card medium 10 or 20 at printing region 25A via operation of drive regions 26, 27, and 28 without interference with rolled medium 36, which remains stationary.

The fundamental operation of micro feed mechanism 30 is as follows. When electromagnetic clutch 30A is in its unactivated state, clutch plate 32 will not be drawn into clutch 30A and, as a result, clutch spring 33 will remain tightly gripped about shaft 5 so that rolled medium drive roller 34 will rotate with shaft 5 via connected clutch spring 33. When electromagnetic clutch 30A is activated, electromagnetic clutch 30A draws in clutch plate 32, which is biased against electromagnetic clutch 30A by compression spring 31. However, since clutch plate 32 is held to the printer frame from rotation at side 33A of clutch spring 33 and clutch spring 33 will begin to uncoil and, thus, slacken and remove its grip on shaft 5. As a result, the driving power of drive shaft 5 is not transmitted to rolled medium feed roller 34 and rolled medium feed roller 34 will not rotate with shaft 5.

Thus, as described above, according to this invention, printer 1 can operatively transport a sheet medium 10, a card medium 20, or a rolled medium 36 in micro increments without medium jamming between respective drive regions of the printer with the employment of only one step motor and, further, wherein a sheet medium 10 or a card medium 20 may be fed into printer 1 for printing by printer mechanism 25 while rolled medium 36 remains positioned in printer 1, as shown in FIG. 10.

Another embodiment of a micro medium feed mechanism 40 of this invention is shown in FIG. 11. Medium feed mechanism 40 relative to drive shaft 43 may be employed in lieu of medium feed mechanism 30 relative to drive shaft 5. Micro medium feed mechanism 40 comprises step motor 41 which is coupled to drive shaft 43 via gear reduction train 42. Drive shaft 43 supports two medium feed mechanisms 44 relative to medium feed frame 48 comprising electromagnetic clutches 47 which operate in the same manner as electromagnetic clutch 30A in FIG. 9. Medium feed rollers 45 are rotatably supported relative to shaft 43 and sheet medium 40A is engaged for incremental movement between either one of the two medium feed rollers 45 and its corresponding medium support roller 46. Thus, clutches 47 can be independently operated so that a sheet, card or rolled medium can be fed relative to either set of rollers 45 and 46, and printing can be accomplished via printer mechanism 25 relative to incremental feeding of one medium 40A in lieu of an adjacently disposed medium (not shown). Also, if both clutches 47 are actuated, then feed rollers 45 become stationary but feed roller 49 fixed to drive shaft 43 will continue to rotate for purposes of continual feeding of another medium (not shown) independently of the operation of either medium feed mechanism 44.

While the invention has been described in conjunction with several specific embodiments, it is evident to those skilled in the art that many further alternatives, modifications and variations will be apparent in light of the foregoing description. Thus, the invention described herein is intended to embrace at such alternatives, modifications, applications and variations as fall within the spirit and scope of the appended claims.

What is claimed is:

1. A micro medium feed mechanism for a printer comprising a step motor for supplying power to feed one or more printing mediums through said printer, a transmission means coupled to said motor and providing a power reduction output of said step motor power, a drive shaft connected to and driven by said transmission means, a plurality of medium feed rollers rotatably supported on said drive shaft and arranged to feed one or more of said mediums upon rotation of said shaft and a plurality of clutch mechanisms to selectively transmit rotational power from said drive shaft to selectively rotate one or more of said medium feed rollers, each of said clutch mechanisms comprising a clutch spring on said drive shaft and adjacent to at least one of said medium feed rollers, one end of said clutch spring fixed relative to said medium feed rollers, a clutch plate rotatably supported relative to said drive shaft adjacent to said clutch spring, the other end of said clutch spring engaged by said clutch plate, an electromagnetic clutch rotatably supported relative to said drive shaft adjacent to said clutch plate and in axial alignment with said clutch spring and said medium feed roller, said electromagnetic clutch when unactivated permitting said clutch spring to immediately grip said drive shaft and rotate said roller therewith, said electromagnetic clutch when activated for drawing said clutch plate further to said electromagnetic clutch to cause disengagement of said clutch spring from said drive shaft to release said clutch spring and said medium feed roller from rotating with said drive shaft and urging means between said clutch spring and said clutch plate to continually maintain said clutch plate biased against said electromagnetic clutch so that, when said electromagnetic clutch is unactivated, the positional relationship between said clutch plate relative to said electromagnetic clutch will be substantially the same so that the amount of time required for each activation of said electromagnetic clutch and disengagement of said clutch spring from said drive shaft will be substantially the same.

2. The micro medium feed mechanism of claim 1 wherein at least one of said medium feed rollers is secured to said drive shaft to continually rotate therewith while the other of said medium feed rollers are intermittently driven by the action of said electromagnetic clutches.

3. The micro medium feed mechanism of claim 1 wherein said urging means comprises a coil spring on said drive shaft between said other clutch spring end and said clutch plate.

4. A printer for concurrently printing two or more recording media in juxtaposed relation and comprising a medium feed mechanism for feeding two or more recording mediums between a medium feed roller and a medium support roller for delivery of the medium for printing, a step motor for supplying power feeding said recording mediums through said feed mechanism via a transmission means coupled to said motor and to a drive shaft connected to be driven by said transmission means.

said medium feed rollers rotatably supported on said drive shaft and arranged to feed one or more of said mediums upon rotation of said shaft and a plurality of clutch mechanisms to selectively transmit rotational power from said drive shaft for selective and intermittent rotation of one or more of said medium feed rollers, each of said clutch mechanisms comprising a clutch spring on said drive shaft and adjacent to one of said medium feed rollers, one end of said clutch spring fixed relative to said medium feed roller, a clutch plate rotatably supported relative to said drive shaft adjacent to said clutch spring, the other end of said clutch spring engaged by said clutch plate, an electromagnetic clutch rotatably supported relative to said drive shaft adjacent to said clutch plate and in axial alignment with said clutch spring and said medium feed roller, said electromagnetic clutch when unactivated permitting said clutch spring to immediately grip said drive shaft and rotate said roller therewith, said electromagnetic clutch when activated for drawing said clutch plate further to said electromagnetic clutch to cause disengagement of said clutch spring from said drive shaft to release said clutch spring and said medium feed roller from rotating with said drive shaft and urging means between said clutch spring and said clutch plate to continually maintain said clutch plate biased against said electromagnetic clutch so that, when said electromagnetic clutch is unactivated, the positional relationship between said clutch plate relative to said electromagnetic clutch will be substantially the same so that the amount of time required for each activation of said electromagnetic clutch and disengagement of said clutch spring from said drive shaft will be substantially the same.

5. The printer of claim 4 wherein at least one of said medium feed rollers is secured to said drive shaft to continually rotate therewith while the other of said medium feed rollers are intermittently driven by the action of said electromagnetic clutches.

6. The printer of claim 4 wherein said urging means comprises a coil spring on said drive shaft between said other clutch spring end and said clutch plate.

* * * * *